US008585047B2

(12) United States Patent
Sato et al.

(10) Patent No.: US 8,585,047 B2
(45) Date of Patent: Nov. 19, 2013

(54) SHEET CONVEYANCE APPARATUS AND RECORDING APPARATUS

(75) Inventors: Ryosuke Sato, Kawasaki (JP); Kenji Shigeno, Yokohama (JP); Koichiro Kawaguchi, Yokohama (JP); Toshiki Takeuchi, Yokohama (JP); Kengo Nieda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/965,774

(22) Filed: Dec. 10, 2010

(65) Prior Publication Data

US 2011/0266742 A1 Nov. 3, 2011

(30) Foreign Application Priority Data

Apr. 28, 2010 (JP) ..... 2010-104295
May 10, 2010 (JP) ..... 2010-108789

(51) Int. Cl.
*B65H 9/00* (2006.01)
*B65H 9/16* (2006.01)

(52) U.S. Cl.
USPC ..... 271/234; 271/236; 271/248; 271/251

(58) Field of Classification Search
USPC ..... 271/226, 248, 250, 253, 251, 234, 236, 271/238, 324; 226/2, 3, 4, 16, 33, 118.1
See application file for complete search history.

(56) References Cited

U.S. PATENT DOCUMENTS 1,010,777 A 12/1911 Leggett
4,334,759 A * 6/1982 Clausing ..... 399/394
4,426,073 A 1/1984 Mizuma
6,032,949 A * 3/2000 Ando ..... 271/225
6,464,065 B2 10/2002 Herubel et al.
7,445,208 B2 * 11/2008 Onodera ..... 271/239
7,469,894 B2 12/2008 Seto
2004/0094891 A1 5/2004 Trovinger
2005/0156373 A1 * 7/2005 Konagaya ..... 271/226

(Continued)

FOREIGN PATENT DOCUMENTS

CN 1403880 A 3/2003
CN 101077745 A 11/2007

(Continued)

OTHER PUBLICATIONS

U.S. Appl. No. 13/084,387, filed Apr. 11, 2011, Masaki Maeno.

(Continued)

*Primary Examiner* — Patrick Cicchino

(74) *Attorney, Agent, or Firm* — Canon U.S.A., Inc. IP Division

(57) ABSTRACT

An apparatus includes a first conveyance unit configured to convey a sheet, a first guide located downstream of the first conveyance unit in a conveyance direction and configured to guide a first side end of the conveyed sheet, a skew unit configured to convey the sheet in an oblique direction to come closer to the first guide, a second guide configured to contact a second side end opposite the first side end to guide the second side end, a second conveyance unit located downstream of the first guide in the conveyance direction, and a control unit configured to perform control so that, after conveying the sheet by the skew unit with the first guide contacting the first side end while the second guide is separated from the second side end, the second guide moves to a position close to the second side end.

18 Claims, 19 Drawing Sheets

(56) References Cited

U.S. PATENT DOCUMENTS

| | | | | |
|---|---|---|---|---|
| 2005/0242493 | A1* | 11/2005 | Agata | 271/226 |
| 2005/0280200 | A1 | 12/2005 | Sagi | |
| 2006/0170149 | A1 | 8/2006 | Seto | |

FOREIGN PATENT DOCUMENTS

| | | | |
|---|---|---|---|
| EP | 1607228 | A2 | 12/2005 |
| JP | H05-216132 | A | 8/1993 |
| JP | 2001-151387 | A | 6/2001 |
| JP | 2002-207259 | A | 7/2002 |
| JP | 2002-249263 | A | 9/2002 |
| JP | 2002-293463 | * | 10/2002 |
| JP | 2002-293463 | A | 10/2002 |
| JP | 2005-156974 | A | 6/2005 |
| JP | 2005-170633 | A | 6/2005 |
| JP | 2007-225947 | A | 9/2007 |

OTHER PUBLICATIONS

U.S. Appl. No. 12/964,681, filed Dec. 9, 2010, Ryosuke Sato.
U.S. Appl. No. 12/945,598, filed Jan. 12, 2010, Koichiro Kawaguchi.
U.S. Appl. No. 12/941,856, filed Nov. 18, 2010, Yosui Naito.
U.S. Appl. No. 12/834,651, filed Jul. 12, 2010, Tetsuhiro Nitta.
U.S. Appl. No. 12/825,071, filed Jun. 28, 2010, Naoki Ishikawa.
U.S. Appl. No. 12/958,245, filed Dec. 1, 2010, Hironori Naka.

* cited by examiner

SHEET CONVEYANCE APPARATUS AND RECORDING APPARATUS

BACKGROUND OF THE INVENTION

1. Field of the Invention

The present invention relates to a sheet conveyance apparatus and a recording apparatus that records an image on a sheet.

2. Description of the Related Art

In an image forming apparatus discussed in Japanese Patent Application Laid-Open No. 2005-156974, misregistration and a misaligned posture of the tip of a long sheet are corrected by causing the long sheet to move along a bump guide in parallel along a conveyance direction by a skew roller pair whose rotation surface is tilted toward the bump guide. Twist tension generated in the long sheet is reduced by generating a loop in a loop conveyance unit provided upstream of the guide immediately before the long sheet being caused to move along the bump guide so that skew correction processing with a reduced load can be performed.

Then, image formation with less skew is realized by sandwiching the sheet between a line feed roller pair on the downstream side and restarting conveyance after the skew roller pair being detached.

However, in a configuration, such as that discussed in Japanese Patent Application Laid-Open No. 2005-156974, in which the skew roller pair is detached after the skew at the tip of a long sheet is corrected to allow the long sheet to be conveyed, an issue actually arises of deteriorating conveyance precision with the sheet skewed during conveyance. Reasons for the issue include a factor that because the skew roller pair is detached, torsional tension of the long sheet directly affects the line feed roller pair to deteriorate conveyance balance, resulting in the skew.

If the long sheet is made to be conveyed along the bump guide by the skew rollers, there is an issue that satisfactory image quality cannot be obtained due to an occurrence of surface defects of the sheet because the sheet is conveyed in a state in which the surface thereof is slidingly rubbed by the skew rollers.

Japanese Patent Application Laid-Open No. 2007-225947 discusses a printing apparatus in which a pair of regulatory guides on the left and right sides is provided on a paper path route of roll paper to prevent meandering. Meandering of the roll paper can be prevented by moving the left and right guides to pushed-in positions narrower than the width of the roll paper to correct the posture of the roll paper and then, moving the roll paper width guide position.

In an apparatus discussed in Japanese Patent Application Laid-Open No. 2007-225947, a conveyance roller is provided upstream and downstream of a paper width guide to sandwich and convey roll paper. When meandering is corrected, pressure contact of the conveyance rollers is released and an operation of pushing in roll paper edges further narrower than the paper width by a guide unit is performed. Also, the position of the guide unit is moved according to the width dimension of the roll paper input into the apparatus in advance.

However, to respond to user needs more wide-ranging than in the past, issues cited below manifest themselves when an attempt is made to obtain better printing results by conveying various media with higher precision than in the past:

(1) If meandering occurs during printing and pressure contact of a conveyance roller is released to correct the meandering by a guide unit, conveyance precision of roll paper deteriorates. If a pressure contact force of the conveyance roller is weakened to correct the meandering without releasing pressure contact, conveyance precision of roll paper also deteriorates. Thus, it is difficult to ensure both excellent conveyance precision and meandering correction performance during printing at the same time.

(2) If an operation to push in the guide unit further narrower than the paper width is performed, buckling may occur depending on rigidity of the roll paper to be used so that damage due to the buckling remains in the roll paper.

(3) While the guide unit is aligned based on the roll paper width size input in advance, a gap may arise between the guide unit and roll paper edges due to an error between the actual roll paper width and the input value, precision of parts of the guide unit, positioning precision or the like, thus increasing the possibility of an occurrence of meandering. Conversely, if the guide position swings in a direction in which the roll paper is pushed in, a phenomenon similar to (2) may occur.

SUMMARY OF THE INVENTION

According to an aspect of the present invention, an apparatus includes a first conveyance unit configured to convey a sheet, a first guide located downstream of the first conveyance unit in a conveyance direction and configured to guide a first side end of the conveyed sheet, a skew unit configured to convey the sheet in an oblique direction to come closer to the first guide, a second guide configured to contact a second side end opposite the first side end to guide the second side end, a second conveyance unit located downstream of the first guide in the conveyance direction, and a control unit configured to perform control so that, after conveying the sheet by the skew unit with the first guide contacting the first side end while the second guide is separated from the second side end, the second guide moves to a position close to the second side end.

According to exemplary embodiments of the present invention, a sheet conveyance apparatus capable of suppressing skew of a sheet with high precision can be provided.

DESCRIPTION OF THE EMBODIMENTS

A recording apparatus using an inkjet system according to a first exemplary embodiment of the present invention is a high-speed line printer that uses a continuous sheet wound like a roll and supports both one-sided printing and two-sided printing. For example, the recording apparatus is suitable for printing of a large quantity of printing in a printing laboratory or the like. The present invention can be widely applied to printing apparatuses such as printers, multifunction peripherals, copying machines, facsimile machines, and manufacturing equipment of various devices. Moreover, in addition to printing processing, the present invention can be applied to sheet processing apparatuses that perform various kinds of processing (such as recording, working, coating, irradiation, reading, and inspection) on roll sheets.

Figure 1:
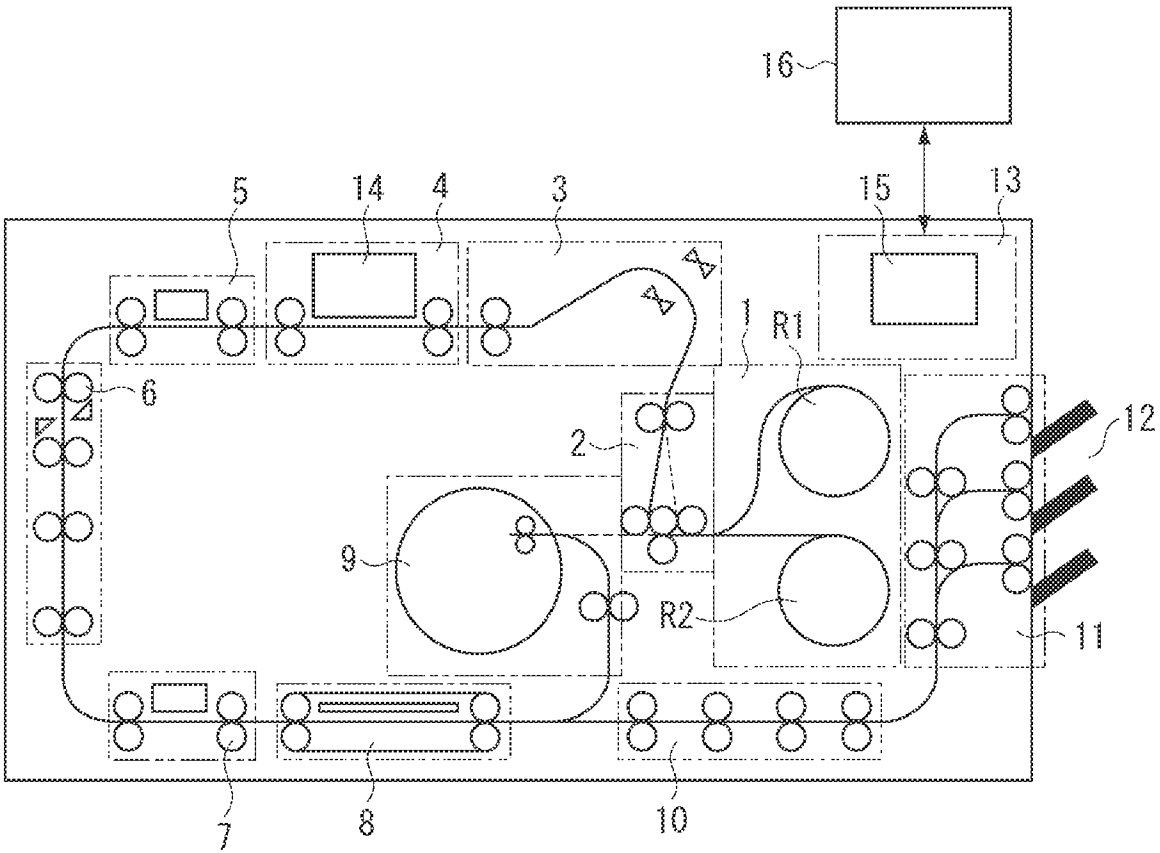
FIG. 1 is diagram illustrating an internal structure of a recording apparatus according to a first exemplary embodiment of the present invention.

FIG. 1 is a sectional view illustrating an internal structure of a recording apparatus. A printing apparatus according to the present exemplary embodiment uses a sheet wound like a roll and can print both sides of a first side of the sheet and a second side on the opposite side of the first side. The recording apparatus roughly includes a sheet feeding unit 1, a decurling unit 2, a skew correction unit 3, a printing unit 4, an inspection unit 5, a cutter unit 6, an information recording unit 7, a drying unit 8, a sheet winding unit 9, a discharge/conveyance unit 10, a sorter unit 11, a discharge tray 12, and a control unit 13. A sheet is conveyed by a transport mechanism composed of a roller pair and a belt along a sheet conveyance route denoted by a solid line in FIG. 1 for processing by each unit. At any position of the sheet conveyance route, the side closer to the sheet feeding unit 1 is called "upstream" and the opposite side "downstream".

The sheet feeding unit 1 is a unit that houses and feeds a continuous sheet wound like a roll. The sheet feeding unit 1 can hold two rolls R1 and R2 and is configured to alternatively pull out and feed the roll. The number of rolls that can be housed is not limited to two and one roll or three rolls or more may be housed.

The decurling unit 2 is a unit that reduces curling (warping) of a sheet fed from the sheet feeding unit 1. The decurling unit 2 uses two pinch rollers for one driving roller to reduce curling by a decurling force by causing the sheet allowed to pass to be curved in such a way that warping opposite to the curling is given.

The skew correction unit 3 is a unit that corrects the skew (tilt to the original traveling direction) of a sheet that has passed through the decurling unit 2. The skew of a sheet is corrected by pushing a sheet edge on the side to be a reference against a guide member.

The printing unit 4 is a unit that forms an image on a sheet by a print head 14, which is a recording unit for a conveyed sheet. The printing unit 4 includes a plurality of conveyance rollers that convey a sheet. The print head 14 has a line print head in which nozzle lines of an inkjet system are formed in a range to cover the maximum width of a sheet whose usage is assumed. The printing unit 4 has a plurality of print heads arranged in parallel along the conveyance direction. In the present exemplary embodiment, the printing unit 4 has seven print heads corresponding to seven colors of C (cyan), M (magenta), Y (yellow), LC (light cyan), LM (light magenta), G (gray), and B (black). However, the number of colors and that of print heads are not limited to seven. As the inkjet system, a system using heater elements, a system using piezoelectric elements, a system using electrostatic elements, a system using MEMS elements or the like can be adopted. The respective colors of ink are supplied from ink tanks thereof to the print head 14 through ink tubes, respectively.

The inspection unit 5 is a unit that determines whether an image is correctly printed by optically reading an inspection pattern or image printed on a sheet by the printing unit 4 and inspecting the state of print head nozzles, sheet conveyance state, and image positions. The inspection unit 5 includes a CCD image sensor or CMOS image sensor as the scanner.

The cutter unit 6 is a unit that includes a mechanical cutter to cut a printed sheet to a predetermined length. The cutter unit 6 also includes a plurality of conveyance rollers to send out a sheet for the next process.

The information recording unit 7 is a unit that records print information (information specific to each image) such as the serial number and date on the back side of a cut sheet.

The drying unit 8 is a unit that dries attached ink in a short time by heating the sheet printed by the printing unit 4. Inside the drying unit 8, the ink attached side is dried by blowing hot air at least from below to the passing sheet. The drying method is not limited to the method of blowing hot air and may be a method of irradiating a sheet surface with electromagnetic waves (such as ultraviolet rays and infrared rays). The drying unit 8 also includes a conveyance belt and a conveyance roller to send out a sheet for the next process.

The sheet conveyance route from the sheet feeding unit 1 to the drying unit 8 described above is called a first route. The first route has a U-turn shape between the printing unit 4 and the drying unit 8 and the cutter unit 6 is positioned at some midpoint of the U-turn shape.

The sheet winding unit 9 (or reversing unit 9) is a unit to reverse a continuous sheet whose front-side printing is completed by temporarily winding the continuous sheet when two-sided printing is performed. The sheet winding unit 9 is provided on a route (loop path) (called a second route) from the drying unit 8 to the printing unit 4 through the decurling unit 2 for supplying the sheet passed through the drying unit 8 to the printing unit 4 again. The sheet winding unit 9 includes a rotating wind-up drum to wind up a sheet. A continuous sheet whose printing on the front side (first side) is completed and which is not yet cut is temporarily wound by the wind-up drum. When winding is completed, the wind-up drum rotates in the opposite direction to feed the wound sheet in the reverse order in which the sheet is wound to the decurling unit 2 before the sheet being fed to the printing unit 4. The sheet is reversed and thus, the rear side (second side) can be printed by the printing unit 4. A more concrete operation of the two-sided printing will be described below.

The discharge/conveyance unit 10 is a unit to convey a sheet cut by the cutter unit 6 and dried by the drying unit 8 to deliver the sheet to the sorter unit 11. The discharge/conveyance unit 10 is provided on a route (called a third route) different from the second route where the sheet winding unit 9 is provided. To selectively lead a sheet conveyed on the first route to one of the second route and the third route, a route switching mechanism having a movable flapper is provided at the branching position of the route.

The sorter unit 11 and the discharge tray 12 are provided near the side of the sheet feeding unit 1 and at an end of the third route. The sorter unit 11 is a unit that distributes and discharges printed sheets in groups to different trays of the discharge tray 12 if necessary. Sorted sheets are discharged to the discharge unit 12 composed of a plurality of trays. Thus, the third route is laid out to discharge a sheet to the opposite side of the printing unit 4 and the drying unit 8 across the sheet feeding unit 1 after passing below the sheet feeding unit 1.

The control unit 13 is a unit that manages control of each unit of the whole recording apparatus. The control unit 13 has a controller 15 including a central processing unit (CPU), memory, and various input/output (I/O) interfaces and a power supply. The operation of the recording apparatus is controlled based on commands from the controller 15 or a host apparatus 211 such as a host computer connected to the controller 15 via an I/O interface.

Figure 2:
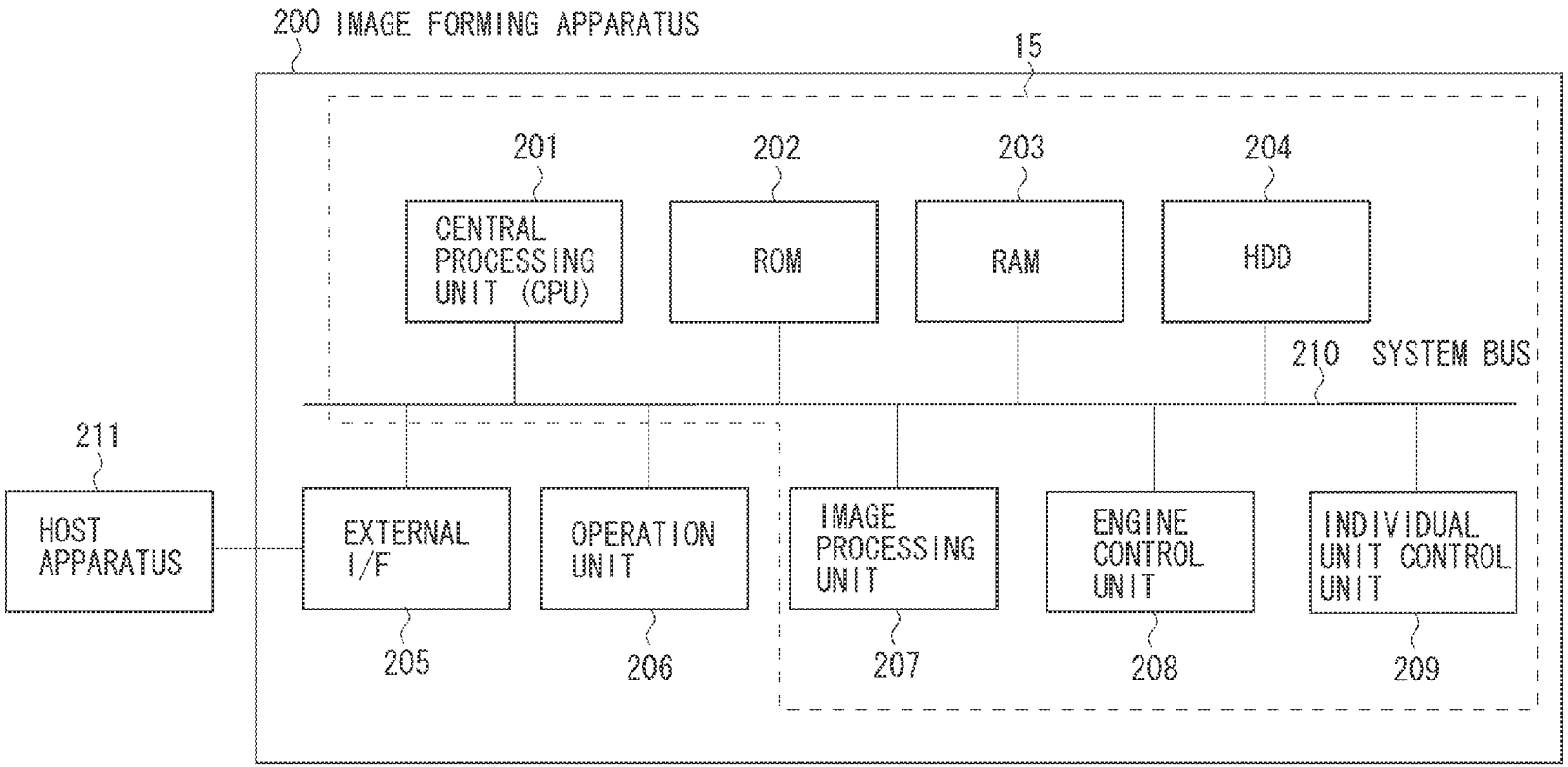
FIG. 2 is a block diagram illustrating a structure of a control unit inside the recording apparatus.

FIG. 2 is a block diagram illustrating the configuration of the control unit 13. The controller 15 (range enclosed by a broken line) contained in the control unit 13 includes a CPU 201, a read-only memory (ROM) 202, a random access memory (RAM) 203, an hard disk drive (HDD) 204, an image processing unit 207, an engine control unit 208, and an individual unit control unit 209. The CPU 201 (central processing unit) controls operations of units of the printing apparatus in a unifying fashion. The ROM 202 stores programs to be executed by the CPU 201 and fixed data for each operation of the printing apparatus. The RAM 203 is used as a work area for the CPU 201 or as a temporary storage area of various kinds of received data or stores various kinds of setting data. The HDD 204 (hard disk) can store programs to be executed by the CPU 201, print data, and setting information for various operations of the printing apparatus, which can also be read therefrom. The operation unit 206 is an input/output interface with a user and includes an input unit such as hard keys and a touch panel and output unit such as a display to provide information and a sound generator.

For a unit that requires high-speed data processing, a dedicated processing unit is provided. The image processing unit 207 performs image processing of print data handled by the printing apparatus. The image processing unit 207 converts the color space (for example, YCbCr) of input image data into the standard RGB color space (for example, sRGB). The image processing unit 207 also performs various kinds of image processing such as resolution conversions, image analysis, and image corrections on image data if necessary. Print data obtained after the above image processing is stored in the RAM 203 or the HDD 204. The engine control unit 208 performs driving control of the print head 14 of the printing unit 4 according to print data based on a control command received from the CPU 201 or the like. The engine control unit 208 further controls the transport mechanism of each unit inside the printing apparatus. The individual unit control unit 209 is a sub-controller to individually control each unit of the sheet feeding unit 1, the decurling unit 2, the skew correction unit 3, the inspection unit 5, the cutter unit 6, the information recording unit 7, the drying unit 8, the sheet winding unit 9, the discharge/conveyance unit 10, the sorter unit 11, and the discharge tray 12. Based on a command by the CPU 201, the individual unit control unit 209 controls the operation of each unit. An external interface 205 is an interface (I/F) to connect the controller to the host apparatus 211 and is a local I/F or a network I/F. The above components are connected by a system bus 210.

The host apparatus 211 is an apparatus serving as a feeding source of image data the printing apparatus is caused to print. The host apparatus 211 may be a general-purpose or dedicated computer or a dedicated imaging device such as an image capturing device, digital camera, and photo storage. If the host apparatus 211 is a computer, the OS, application software that generates image data, and a printer driver for the printing apparatus are installed into a storage apparatus of the computer. Incidentally, it is not necessary to realize all above processing by software and part or all of the above processing may be realized by hardware.

Next, the basic operation of printing will be described. The operation of one-sided printing and that of two-sided printing are different and thus, each type of printing will be described.

Figure 3:
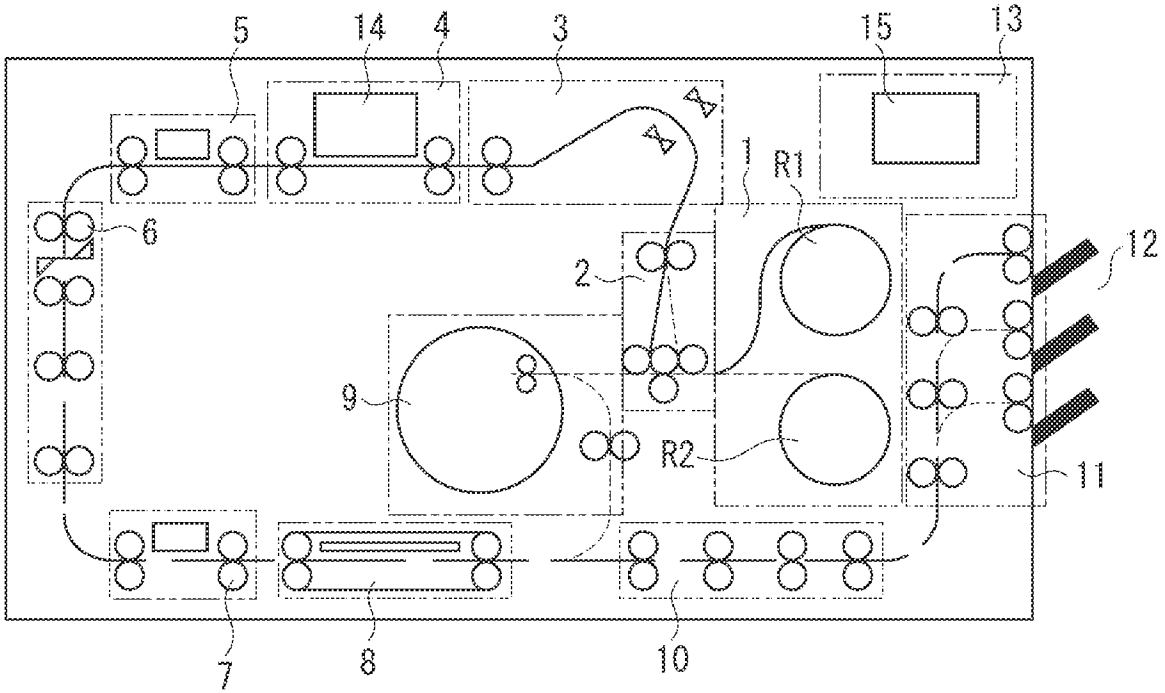
FIG. 3 is a diagram illustrating an operation of the recording apparatus when one-sided printing is performed.

FIG. 3 is a diagram illustrating the operation of the recording apparatus when one-sided printing is performed. The conveyance route when a sheet fed by the sheet feeding unit 1 is printed and discharged to the discharge tray 12 is denoted by a thick line. The sheet fed by the sheet feeding unit 1 and processed by each of the decurling unit 2 and the skew correction unit 3 is printed on the front side (first side) by the printing unit 4. For a long continuous sheet, a plurality of images is formed by sequentially printing and arranging an image (unit image) of a predetermined length in the conveyance direction. The printed sheet is cut every unit image by the cutter unit 6 after passing through the inspection unit 5. Print information is recorded on the back side of cut sheets by the information recording unit 7 if necessary. Then, cut sheets are conveyed to the drying unit 8 one by one for drying. Subsequently, cut sheets are sequentially discharged and stacked onto the discharge tray 12 of the sorter unit 11 after passing through the discharge/conveyance unit 10. On the other hand, the sheet left on the side of the printing unit 4 after the last unit image being cut is sent back to the sheet feeding unit 1 where the sheet is wound by the roll R1 or the roll R2.

Thus, in one-sided printing, a sheet is processed by passing through the first route and the third route and does not pass through the second route. In summary, a sequence of operations (1) to (6) shown below is executed under the control of the control unit 13 in a one-sided printing mode:

(1) Feed a sheet to the printing unit 4 by sending out the sheet from the sheet feeding unit 1;
(2) Repeat printing of unit images by the printing unit 4 on the first side of the fed sheet;
(3) Repeat cutting the sheet by the cutter unit 6 to unit images printed on the first side;
(4) Pass sheets cut every unit image through the drying unit 8 one by one;
(5) Discharge sheets passed through the drying unit 8 one by one to the discharge tray 12 through the third route; and
(6) Send the sheet left after the last unit image being cutback to the sheet feeding unit 1.

Figure 4:
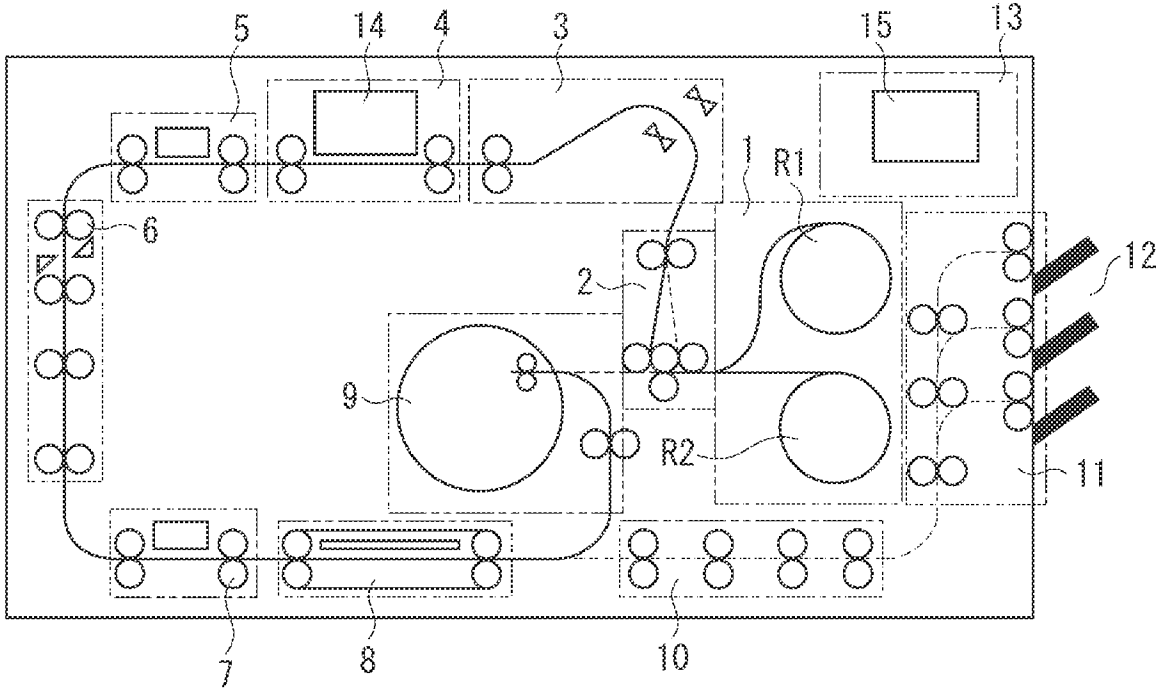
FIG. 4 is a diagram illustrating an operation of the recording apparatus when two-sided printing is performed.

FIG. 4 is a diagram illustrating the operation of the recording apparatus when two-sided printing is performed. In two-sided printing, a front side printing sequence is executed and then, a back side printing sequence is executed. In the first front side printing sequence, the operation of each unit from the sheet feeding unit 1 to the inspection unit 5 is the same as that in the above one-sided printing. The cutting operation by the cutter unit 6 is not performed and the continuous sheet is directly conveyed to the drying unit 8. After ink on the surface is dried by the drying unit 8, the sheet is introduced into the route (second route) on the side of the sheet winding unit 9, instead of the route (third route) on the side of the discharge/conveyance unit 10. The tip of the sheet introduced into the second route is sandwiched between a roller pair 9*b* provided in a wind-up drum 9*a* of the sheet winding unit 9. While the sheet tip sandwiched between the roller pair 9*b*, the wind-up drum 9*a* rotates in the forward direction (counterclockwise in the drawing) and the sheet is wound. When printing of all scheduled surfaces is completed in the recording unit 4, the back end of a print area of the continuous sheet is cut by the cutter unit 6. Using the cut position as a reference, the continuous sheet on the downstream side (printed side) in the conveyance direction is all wound up to the back end (cut position) of the sheet by passing through the drying unit 8. On the other hand, the continuous sheet on the upstream side from the cut position in the conveyance direction is rewound by the sheet feeding unit 1 so that the sheet tip (cut position) is not left in the decurling unit 2 and the sheet is wound by the roll R1 or the roll W2. With this rewinding, collision with the sheet fed again in the back side printing sequence below can be avoided.

After the front side printing sequence described above, the printing sequence is switched to the back side printing sequence. The wind-up drum of the sheet winding unit 9 rotates opposite to the direction for winding (clockwise in the drawing). The edge of the wound sheet (the sheet back end during winding becomes the sheet tip when the sheet is sent out) is fed into the decurling unit 2 along a route of a broken line in FIG. 4. The decurling unit 2 corrects curling attached by a winding rotator. More specifically, the decurling unit 2 is provided between the sheet feeding unit 1 and the printing unit 4 on the first route and between the sheet winding unit 9 and the printing unit 4 on the second route to serve as a common unit acting for decurling on both routes. The decurling unit 2 makes a curling correction opposite to the direction of the previous one and at the same time, reverses the sheet on a conveyance route inside the decurling unit. Then, the back side of the continuous sheet is printed by the printing unit 4 after passing through the skew correction unit 3. The printed sheet passes through the inspection unit 5 before being cut every unit image by the cutter unit 6. After the printed sheet being cut, cut sheets (printed matter) having unit images recorded on both sides are produced. Cut sheets are printed on both sides and thus, the information recording unit 7 makes no recording. Cut sheets are conveyed one by one to the drying unit 8 and sequentially discharged and stacked onto the discharge tray 12 of the sorter unit 11 after passing through the discharge/conveyance unit 10.

Thus, in two-sided printing, a sheet is processed by passing through the first route, the second route, the first route, and the third route in this order. In summary, a sequence of operations (1) to (11) shown below is executed under the control of the control unit 13 in a two-sided printing mode:

(1) Feed a sheet to the printing unit 4 by sending out the sheet from the sheet feeding unit 1;
(2) Repeat printing of unit images by the printing unit 4 on the first side of the fed sheet;
(3) Pass the sheet whose first side is printed through the drying unit 8;
(4) Lead the sheet that has passed through the drying unit 8 to the second route to wind the sheet around the winding rotator held by the sheet winding unit 9;
(5) After repeated printing on the first side is completed, cut the sheet by the cutter unit 6 at a position after the unit image has been printed last;
(6) Wind the sheet around the winding rotator until the edge of the cut sheet reaches by passing through the drying unit 8. Also, send the sheet left on the side of the printing unit 4 after being cut back to the sheet feeding apparatus 1;
(7) When winding is completed, rotate the winding rotator in the opposite direction to feed the sheet again to the printing unit 4 from the second route;
(8) Repeat printing of unit images on the second side of the sheet fed from the second route by the printing unit 4;
(9) Repeat cutting the sheet by the cutter unit 6 to unit images printed on the second side;
(10) Pass sheets cut every unit image through the drying unit 8 one by one; and
(11) Discharge sheets passed through the drying unit 8 one by one to the discharge tray 12 through the third route.

Next, the skew correction unit 3 in a recording apparatus configured as described above will be described in more detail.

Figure 5:
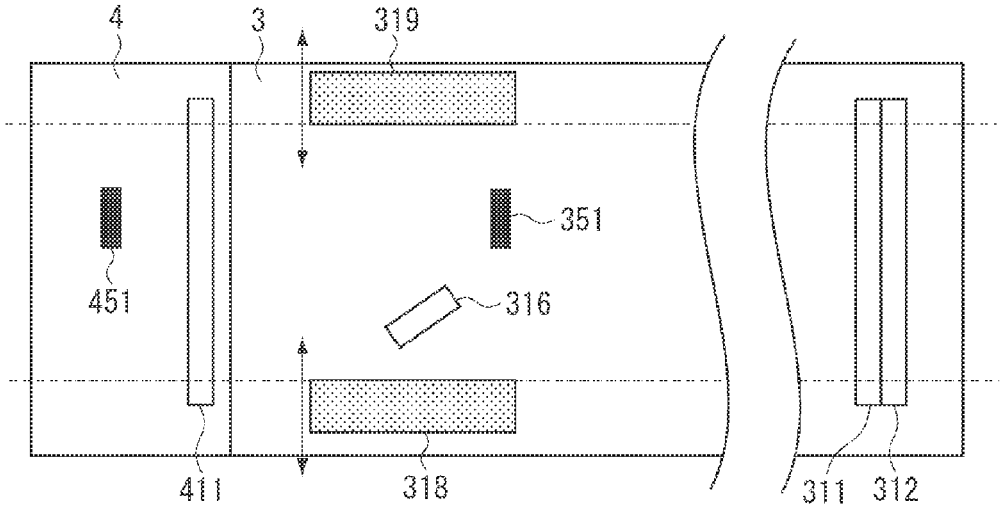
FIG. 5 is a top view illustrating a skew correction unit.
Figure 6:
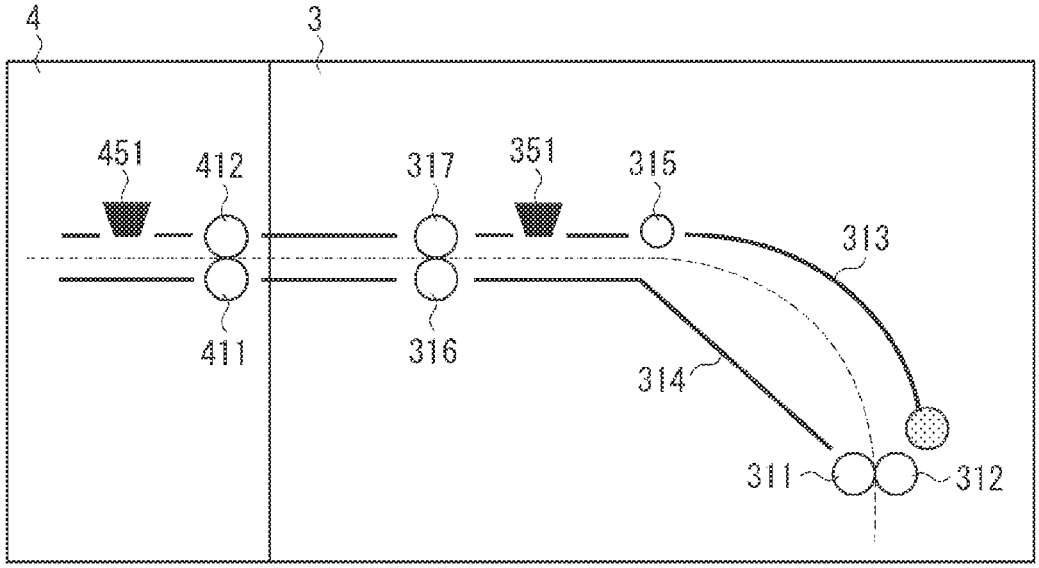
FIG. 6 is a sectional view illustrating the skew correction unit.
Figure 7:
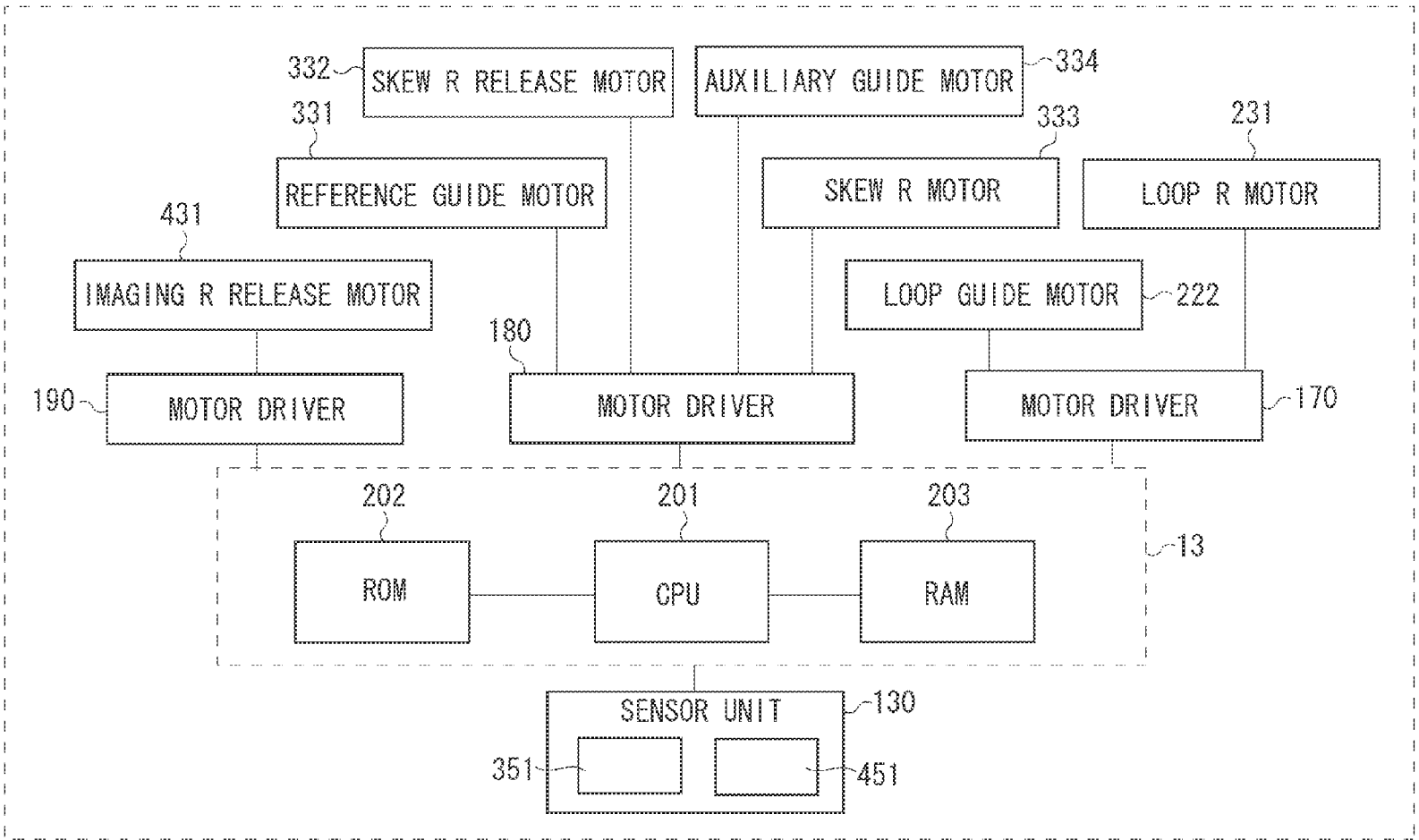
FIG. 7 is an explanatory view of the control unit for the skew correction unit.

FIGS. 5 and 6 are diagrams illustrating the first exemplary embodiment of the skew correction unit. FIG. 7 is a control block diagram of the skew correction unit.

The skew correction unit includes a first driving roller 311, a first driven roller 312, a top surface guide 313, a bottom surface guide 314, a roller 315, a skew driving roller 316, a skew driven roller 317, a reference guide 318, and an auxiliary guide 319 from upstream.

The skew correction unit has a curved paper path of substantially 90 degrees between the first driving roller 311 and the roller 315. The skew correction unit includes a driving transmission unit that transmits driving from a loop R motor 231 (FIG. 7) to the first driving roller 311 and the first driving roller 311 rotates by being linked to the rotation of the loop R motor 231. The top surface guide 313 and the bottom surface guide 314 form a portion of a conveyance unit that guides a sheet from the first driving roller 311 to the downstream side. The skew correction unit includes a driving transmission unit that transmits driving from a loop guide motor 222 to the top surface guide 313 and has a mechanism to open/close the top surface guide 313 by being linked to the rotation of the loop guide motor 222.

The skew driving roller 316 rotates by being driven by a skew R motor 333. The skew driven roller 317 can be moved between a position in contact with the skew driving roller 316 by pressure by a skew R release motor 332 and a position away from the skew driving roller 316. The reference guide 318, which is a first guide, can be moved by a reference guide motor 331 in a direction crossing the conveyance direction. The reference guide 318 is moved by the reference guide motor 331 to the reference position of a first sheet side end, which is one side edge of a sheet. The reference guide 318 that has moved to the reference position comes into contact with the first sheet side end, which is one side edge of the sheet conveyed by the skew driving roller 316 in an oblique direction, and guides the first sheet side end to make a skew correction of the sheet.

Similarly, the auxiliary guide 319 can be moved by an auxiliary guide motor 334 in a direction crossing the conveyance direction. The auxiliary guide 319, which is a second guide, is moved to a position away from the reference guide 318 by a distance corresponding to the sheet width by the auxiliary guide motor 334 to guide a second sheet side end on the opposite side of the first sheet side end. The sheet is prevented from being skewed by both side ends of the sheet being guided by the reference guide 318 and the auxiliary guide 319 away from each other by the sheet width.

The printing unit 4 has a second driving roller 411 and a second driven roller 412. The second driven roller 412 can be moved between a position in contact with the second driving roller 411 by pressure by an imaging R release motor 431 and a position away from the second driving roller 411.

In FIG. 7, the control unit 13 is a main control unit of the above recording apparatus. The control unit 13 has the CPU 201, the ROM 202 in which programs, necessary tables, and other fixed data are stored, and the RAM 203 in which an area where image data is expanded, a work area and the like are provided.

A sensor unit 130 is a group of sensors to detect the state of the apparatus. In the present exemplary embodiment, in addition to a first sheet tip detection sensor 351 and a second sheet tip detection sensor 451, the recording apparatus has a temperature sensor provided to detect an environmental temperature sensor (not illustrated) and various sensors.

A motor driver 170 drives a loop R motor 231 and a loop guide motor 222. The first driving roller 311 is driven by driving the loop R motor 231 to have the sheet conveyed in a downstream direction. The top surface guide 313 is opened/closed by driving the loop guide motor 222.

A motor driver 180 drives the skew R motor 333, the auxiliary guide motor 334, the skew R release motor 332, and the reference guide motor 331. The skew driving roller 316 is driven by driving the skew R motor 333 to have the sheet conveyed obliquely to the reference guide. Skew rollers are attached or detached by driving the skew R release motor 332. The auxiliary guide 319 is driven by the auxiliary guide motor 334 and the reference guide 318 is driven by the reference guide motor 331 so that each guide is brought into contact with the sheet edge on the side on which each is arranged.

A motor driver 190 drives the imaging R release motor 431. The second driven roller 412 is attached or detached by driving the imaging R release motor 431.

Figure 8A:
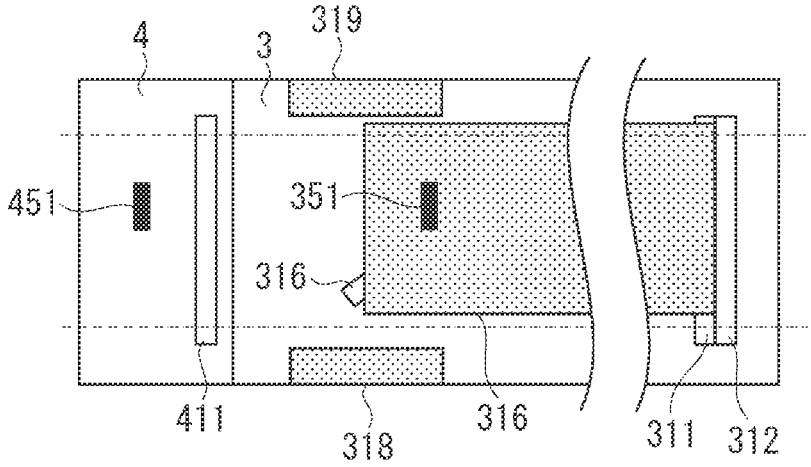
FIGS. 8A to 8D are top views illustrating the operation for skew prevention processing.
Figure 8B:
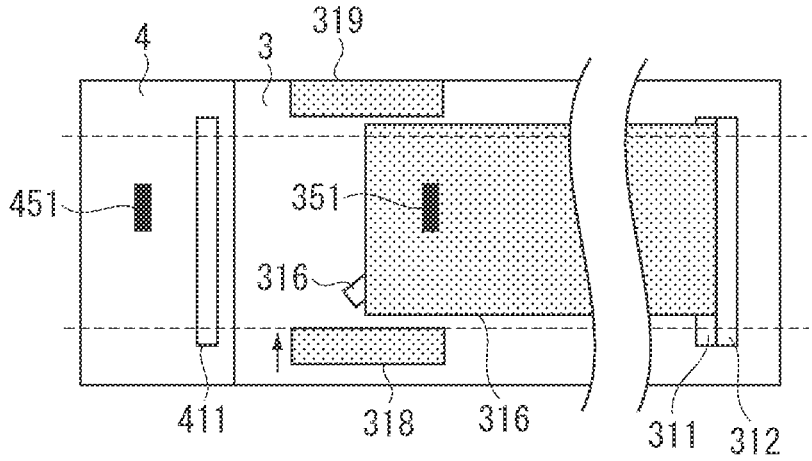
Figure 8C:
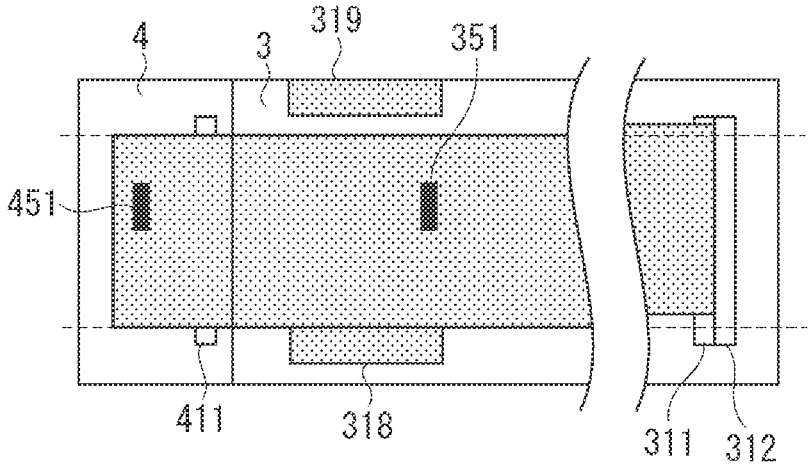
Figure 8D:
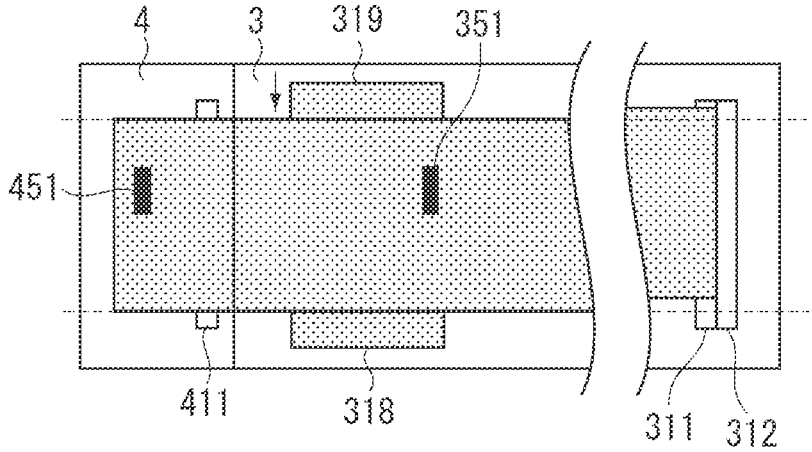
Figure 9A:
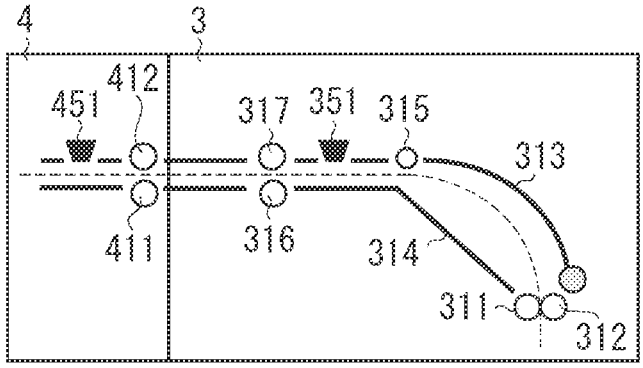
FIGS. 9A to 9D are top views illustrating the operation for the skew prevention processing.
Figure 9B:
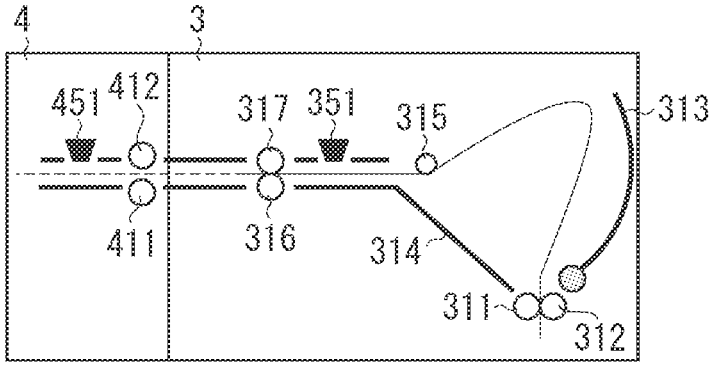

FIGS. 8A to 8D and FIGS. 9A to 9D are diagrams illustrating skew prevention processing. FIG. 10 is a flow chart of the skew prevention processing.

When paper feeding is started, the controller 15 drives the loop R motor 231 so that the first driving roller 311 starts to rotate. As illustrated in FIG. 9A, a continuous sheet conveyed from upstream is conveyed by the first driving roller 311 and the first driven roller 312 and the tip of the continuous sheet passes through a conveyance path in a curved shape of substantially 90 degrees while the top surface guide 313 is closed. At this point, the skew driven roller 317 is positioned detached from the skew driving roller 316. The reference guide 318 and the auxiliary guide 319 are positioned, as illustrated in FIG. 8A, retracted from the sheet path in the sheet width direction.

If, in step S102, the sheet tip is detected by the first sheet tip detection sensor 351 arranged in the skew correction unit 3 (YES in step S102), processing proceeds to step S103. In step S103, the controller 15 stops the loop R motor 231 and all conveyance rollers upstream thereof simultaneously in the timing when the sheet tip reaches between the skew driving roller 316 and the skew driven roller 317.

In step S104, as illustrated in FIG. 8B, the controller 15 drives the reference guide motor 331 to move the reference guide 318 to the sheet edge reference position. In step S105, the controller 15 drives the skew R release motor 332 to sandwich the sheet tip between the skew driving roller 316 and the skew driven roller 317. Next, in step S106, as illustrated in FIG. 9B, the controller 15 drives the loop guide motor 222 to open the top surface guide 313 so that a loop area that permits sheet deformation of the sheet is formed. In step S107, the controller 15 simultaneously drives the first driving roller 311 and all conveyance rollers upstream thereof to form a loop.

Figure 9C:
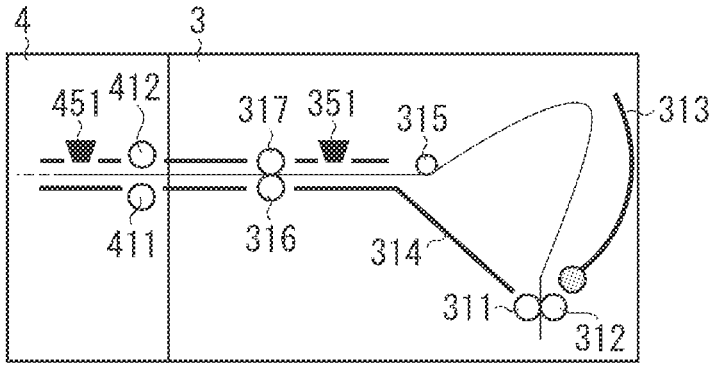
Figure 10:
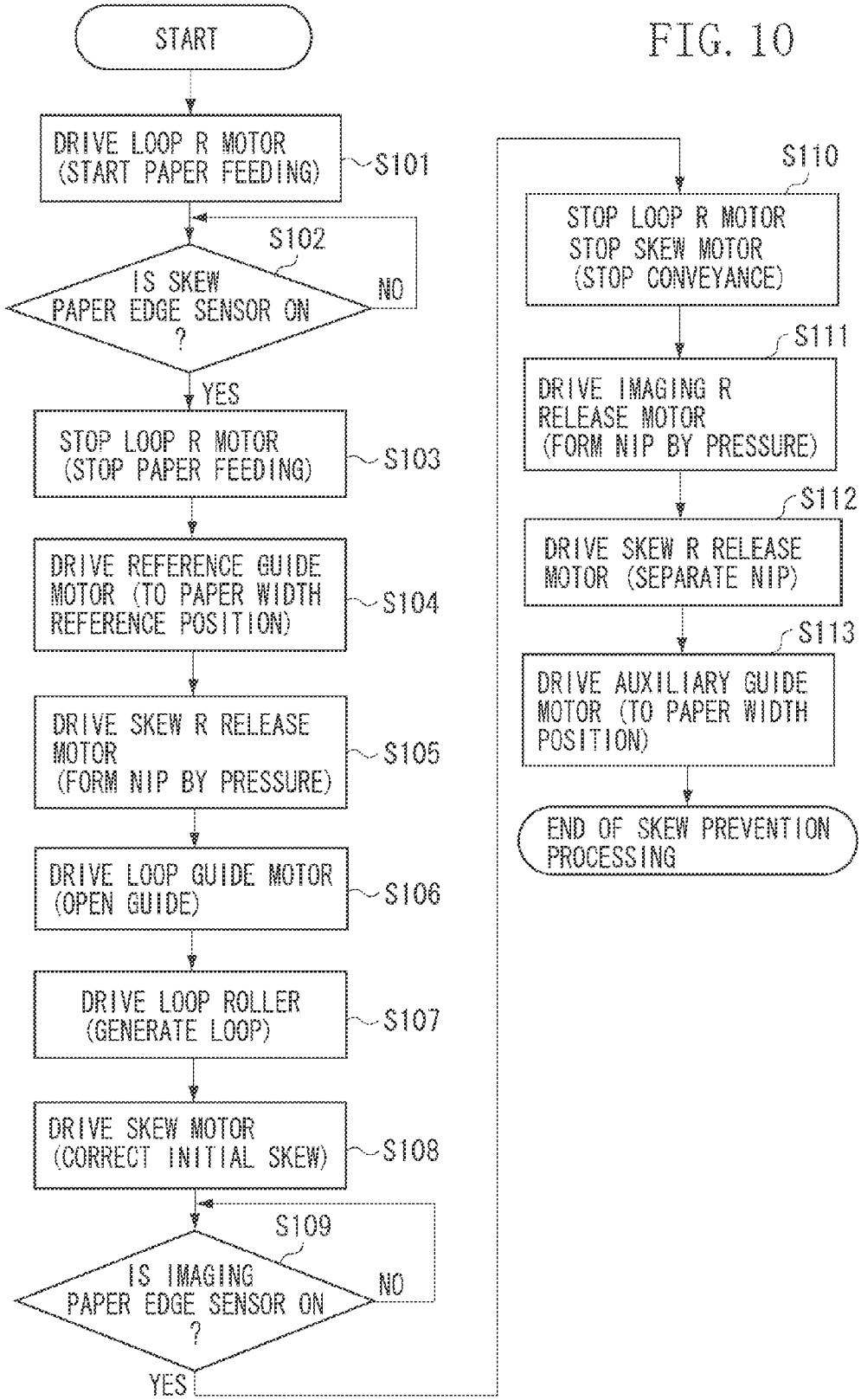
FIG. 10 is a flow chart for the skew prevention processing.

After a loop sufficient for skew correction is formed in the continuous sheet, in step S108, the controller 15 drives the skew driving roller 316 at a speed so that, as illustrated in FIGS. 8C and 9C, the loop is maintained in a fixed state. At this point, the second driven roller 412 is positioned detached from the second driving roller 411.

The conveyance direction of the skew driving roller 316 is tilted toward a direction in which the continuous sheet is pressed against the reference guide 318 and thus, the side end of the continuous sheet is pressed against the reference guide 318 while the continuous sheet is being conveyed in the normal conveyance direction. The continuous sheet is conveyed while the side end thereof is slidingly rubbed against the reference guide 318 to correct the skew.

If, in step S109, the sheet tip is detected by the second sheet tip detection sensor 451 arranged in the printing unit 4 (YES in step S109), processing proceeds to step S110, in which the controller 15 stops the loop R motor 231, the skew R motor 333, and all conveyance rollers upstream thereof simultaneously.

Figure 9D:
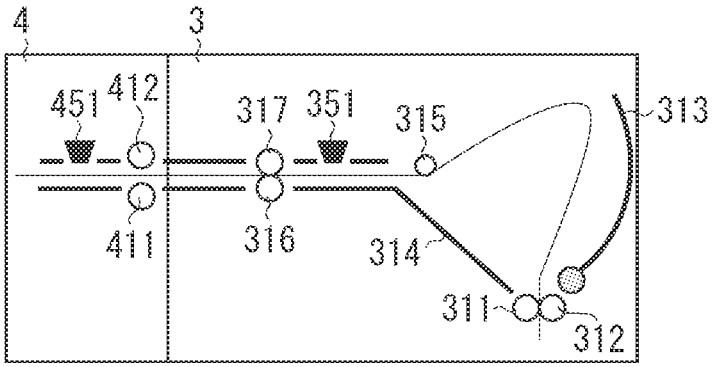

In step S111, the controller 15 drives the imaging R release motor 431 to sandwich the sheet tip, as illustrated in FIG. 9D, between the second driving roller 411 and the second driven roller 412. In step S112, the controller 15 drives the skew R release motor 332 to detach the skew driving roller 316 from the skew driven roller 317. In step S113, the controller 15 drives the auxiliary guide motor 334 and, as illustrated in FIG. 8D, the auxiliary guide 319 moves to a position closer to the sheet edge (second sheet side end) on the opposite side of the reference guide 318 before a sequence of skew prevention processing being terminated. Then, the controller 15 restarts conveyance to perform recording by the recording unit of the printing unit 4. While the spacing between the reference guide 318 and the auxiliary guide 319 at this point is ideally the same distance as the width of a sheet, the spacing may be made a little wider by allowing for an error of the sheet width.

Thus, according to the first exemplary embodiment, when a sheet conveyed by the first driving roller 311 is detected by the first sheet tip detection sensor 351, a loop is generated between the first driving roller 311 and the skew driving roller 316. The skew driving roller 316 is driven to have the sheet conveyed to the printing unit 4 while the sheet is brought into contact with the reference guide 318. When the conveyed sheet is detected by the second sheet tip detection sensor 451, the auxiliary guide 319 is moved to the sheet edge position and the skew is prevented by making the sheet to be conveyed while both edges of the sheet are brought into contact with the reference guide 318 and the auxiliary guide 319.

According to the first exemplary embodiment, a loop is generated to reduce torsional tension of a continuous sheet and, therefore, the continuous sheet can be made to smoothly move along the reference guide 318 while causing a skew unit to convey the continuous sheet so that the skew at the tip of the continuous sheet can easily be corrected.

Moreover, an influence of torsional tension of a continuous sheet on the printing unit 4 can be reduced by sandwiching the sheet between conveyance units of the printing unit 4 and while the skew at the tip of the sheet is corrected and guiding both side ends of the continuous sheet by the reference guide 318 and an auxiliary guide 319.

Through a sequence of operations, the skew can be suppressed when conveyance is restarted and a sheet conveyance apparatus with less disturbed images can be provided.

Figure 11:
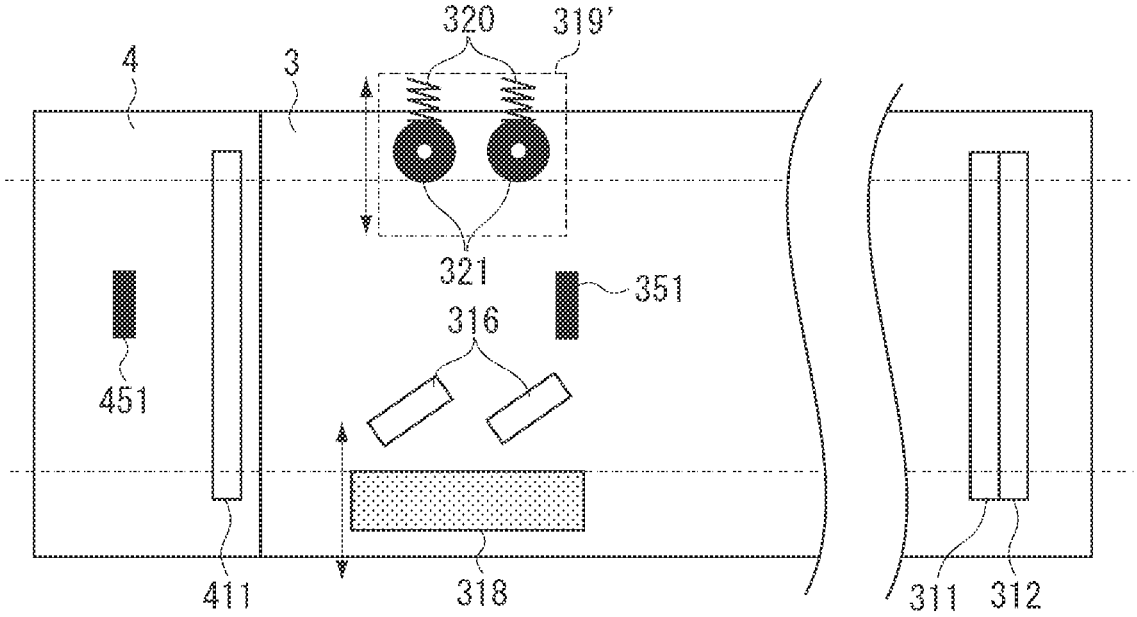
FIG. 11 is a top view illustrating the operation for the skew prevention processing according to a second exemplary embodiment of the present invention.

FIG. 11 is a diagram illustrating the skew correction unit according to a second exemplary embodiment of the present invention.

The skew correction unit includes, as illustrated in FIG. 11, the first driving roller 311, the first driven roller 312, the skew driving roller 316, the reference guide 318, and an auxiliary guide 319'. The auxiliary guide 319' includes a compression spring 320, which is an elastic member, and a rolling pair 321 including two rollers and causes a pressing force in a direction crossing the conveyance direction to act on a sheet edge by the compression spring 320 via the rolling pair 321. The auxiliary guide 319' is connected to an auxiliary guide motor (not illustrated) through driving and has a mechanism to move in the direction crossing the conveyance direction by being linked to rotation of the motor. Though not illustrated in FIG. 11, the skew correction unit includes, like the first exemplary embodiment, a top surface guide, a bottom surface guide, and a roller forming a curved conveyance path between the first driving roller 311 and the first sheet tip detection sensor 351. Further, a nip is formed after a skew driven roller being brought into contact with the skew driving roller 316 by pressure.

Like in the first exemplary embodiment, when a continuous sheet conveyed up to the printing unit 4 while being brought into contact with the reference guide 318 by a skew unit is detected by the second sheet tip detection sensor 451, driving of each conveyance roller and the skew unit is stopped.

Then, the sheet tip is sandwiched between the second driving roller 411 and the second driven roller 412 and the skew driven roller 317 is moved away from the skew driving roller 316. In this state, the auxiliary guide 319' retracted from the sheet edge position moves to the sheet edge position to perform skew prevention processing by pressing the edge of the continuous sheet in a direction crossing the conveyance direction.

The block diagram of the control unit in the present exemplary embodiment has the same configuration as that in the first exemplary embodiment and thus, an illustration and a description thereof will not be repeated.

According to the second exemplary embodiment, a continuous sheet can be made to be conveyed by reliably guiding the continuous sheet with a simple configuration that does not use a sensor or a special control unit irrespective of the width tolerance of a sheet.

Figure 12A:
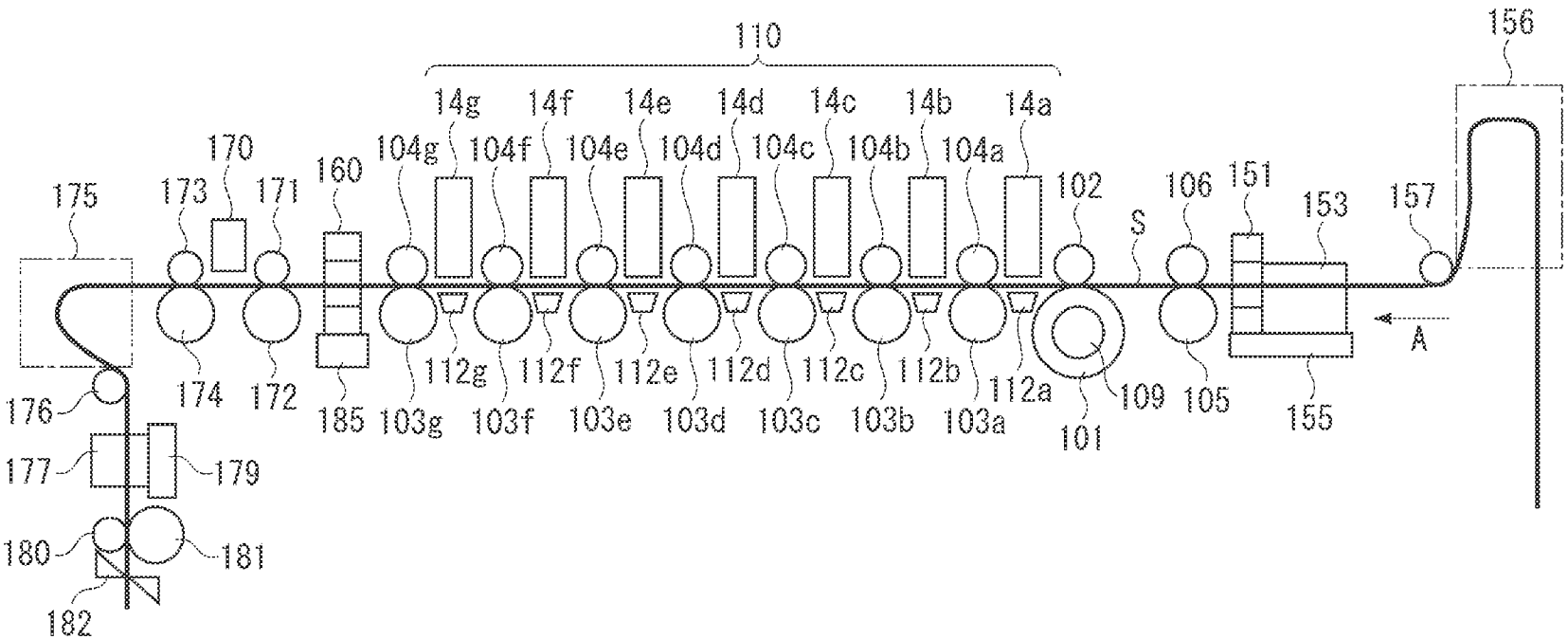
FIGS. 12A and 12B are a sectional view and a top view of a detailed configuration of a printing unit, respectively.
Figure 12B:
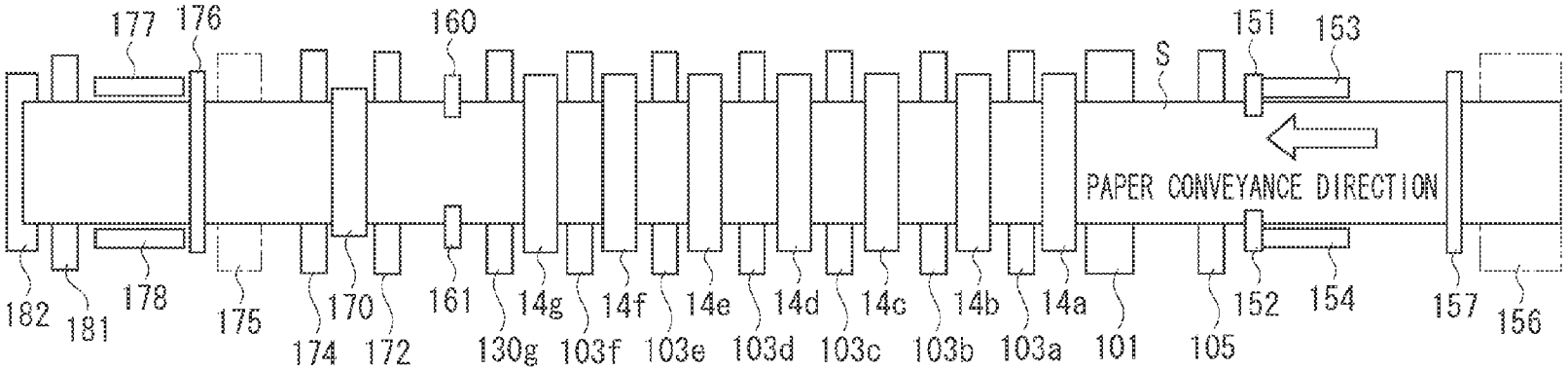

Next, a third exemplary embodiment of the present invention will be described. FIGS. 12A and 12B illustrate a configuration of the printing unit 4. In the printing unit 4, a sheet S is conveyed in an arrow A direction by three roller pairs, i.e., a first roller pair, a second roller pair, and a third roller pair. The first roller pair is a roller pair constituted of a conveyance roller 101 having a driving force and a pinch roller 102 that rotates by being driven. The pinch roller is configured to generate a pressing force in a conveyance roller direction by a spring (not illustrated) and excellent conveyance precision in the printing unit can be ensured by a pressing force in the range of 10 to 20 kgf. The second roller pair refers to each roller pair (seven sets) constituted of a plurality of pinch rollers 104*a* to 104*g* that rotate by being driven. The third roller pair is a roller pair constituted of a conveyance roller 105 having a driving force and a pinch roller 106 that rotates by being driven. The pinch roller pressing force of the second roller pair and that of the third roller pair are each set to about 1 kgf. A rotary encoder 109 is provided to detect the roller rotating state in the conveyance roller 101.

In a print area 110 downstream of the first conveyance roller pair, seven line print heads 14*a* to 14*g* corresponding to each color are arranged along the sheet conveyance direction. The line print heads 14*a* to 14*g* and the pinch rollers 104*a* to 104*g* are alternately arranged one by one. Platens 112*a* to 112*g* are provided at positions opposite to the print heads 14*a* to 14*g* respectively to support the sheet S. Both sides of the sheet S are nipped by a roller pair and supported by a platen at each of positions opposite to the print heads 14*a* to 14*g* so that a behavior of sheet conveyance is stabilized. Particularly when a sheet is first introduced, the sheet tip passes through a plurality of nip positions in a short period so that lifting of the sheet tip is suppressed, leading to stable introduction of the sheet.

A loop area 156 forms a loop shape on a sheet and a loop guide 157 controls the loop shape. Meandering correction guides 153 and 154, which are a pair of edge guide members, are arranged at two locations opposite to both edges of the sheet near the loop area 156 on the downstream side. The meandering correction guide 153 guides sheet edges after coming into contact with at least one side edge of the sheet. Further, sheet edge sensors 151 and 152, which are sheet edge detection units to detect sheet edge positions, are provided in the vicinity thereof on the downstream side. The configuration of the meandering correction guide and that of the sheet edge sensor will be described with reference to FIG. 13A. The meandering correction guides 153 and 154 include contact surfaces 153*a* and 154*a*, which are bottom surface guide units to prevent meandering by coming into contact with sheet edges. The meandering correction guides 153 and 154 also include guide surfaces 153*b* and 154*b* to guide the bottom surface of the sheet. The sheet edge sensors 151 and 152 are transmission position detection sensors by infrared rays. Infrared rays are emitted from emitting units 151*b* and 152*b* and the sheet edge position is detected based on the amount of infrared rays received by receiving units 151*a* and 152*a*. A movement guide 155 moves the sheet edge sensors 151 and 152 and the meandering correction guides 153 and 154 in the sheet width direction. The movement guide includes lead screws (not illustrated) and a driving motor. The meandering correction guide 153 and the sheet edge sensor 151 are integrally fixed and configured to be integrally movable to any position. The sheet edge contact surface 153*a* of the meandering correction guide 153 and the sensor units 151*a* and 151*b* of the sheet edge sensor 151 are assembled with almost no error of distance therebetween by adjusted assembly in which the assembly is performed while making measurements. The meandering correction guide 154 and the sheet edge sensor 152 arranged at an edge on the opposite side of the sheet have a similar configuration. The meandering correction guide is also adjust-assembled to be at right angles to the first conveyance roller pair. The first conveyance roller pair has the highest sheet conveyance power and a dominant influence on conveyance precision and thus, an extremely large meandering correction to the conveyance direction is not made by right angle adjustments of the meandering correction guide so that reasonable and precise conveyance can be achieved.

Figure 14:
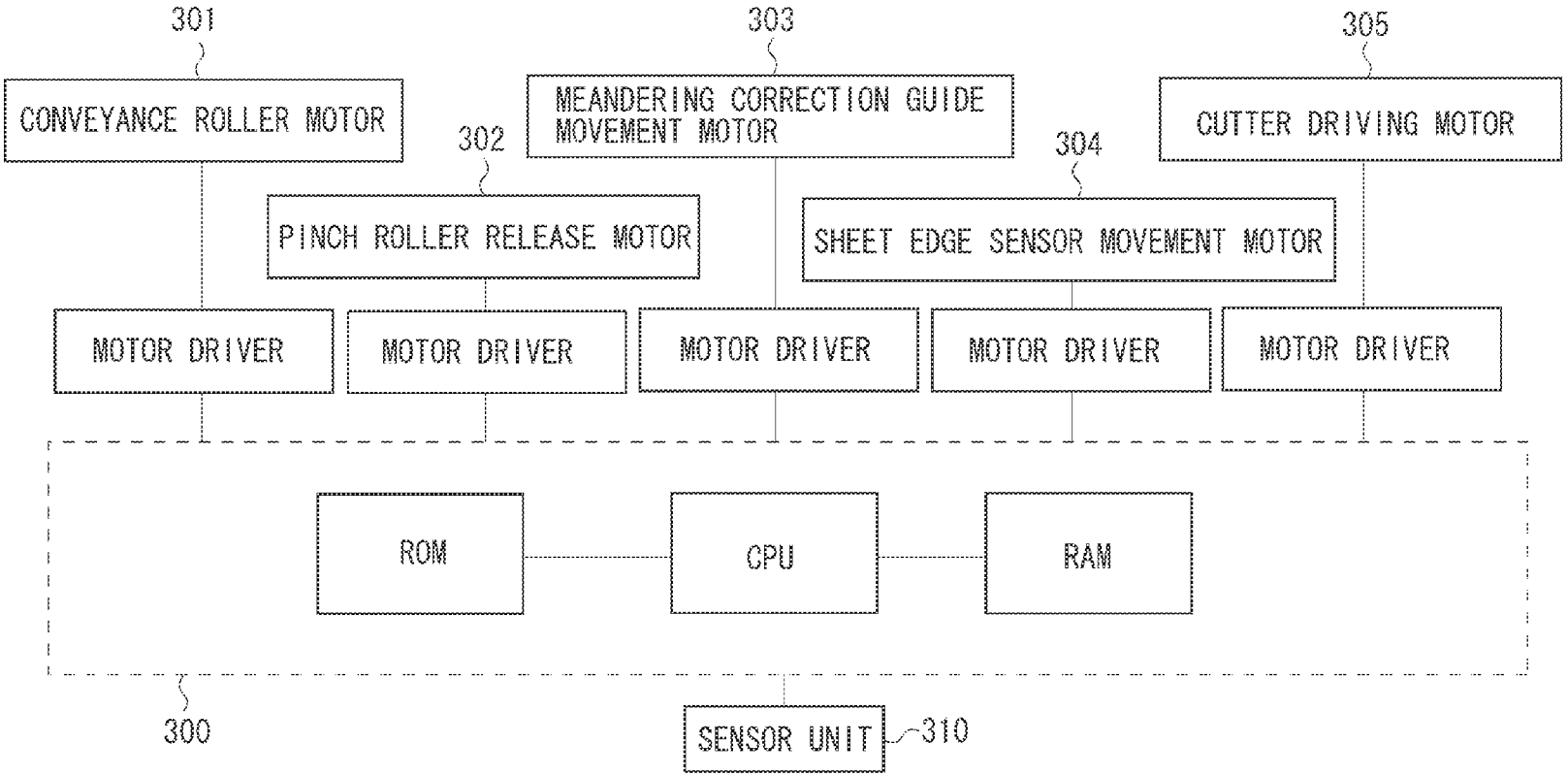
FIG. 14 is an explanatory view of a control unit for a conveyance unit and a meandering correction unit.

Second sheet edge sensors 160 and 161 are second sheet edge detection units to detect the sheet edge position. A second movement guide 185 can move the second sheet edge sensors to any position in the sheet width direction. The printing unit 4 also includes a scanner 170, scanner rollers 172 and 174 that convey a sheet before or after the scanner, and pinch rollers 171 and 173 to press the sheet. A second loop area 175 forms a loop of a sheet between the scanner 170 and a cutter 182. A second loop guide 176 controls the loop shape. Second meandering correction guides 177 and 178 are second edge guide members that guide sheet edges by coming into contact with at least one side edge of the sheet. A third movement guide 179 moves the second meandering correction guides to any position in the sheet width direction. A pre-cutter conveyance roller 181 is arranged downstream of the second meandering correction guides and a pinch roller 180 presses the sheet. FIG. 14 is a block diagram of the configuration of a control unit. A controller 300 includes a ROM, RAM, and a CPU. A sensor unit 310 is a group of sensors to detect the state of the apparatus. A conveyance roller motor 301 drives each conveyance roller to convey a sheet and a pinch roller release motor 302 is a nip release mechanism that performs a pinch roller release operation to release nip pressure of the conveyance rollers. A motor 303 is a guide movement unit to move the meandering correction guides. The motor 303 serves both as a second guide movement unit that moves a second guide member and as a second sheet detection unit movement unit that moves a second sheet edge detection unit. A motor 304 moves the second sheet edge sensor. A motor 305 operates a cutter. Each motor is controlled by each of the motor drivers.

Figure 15:
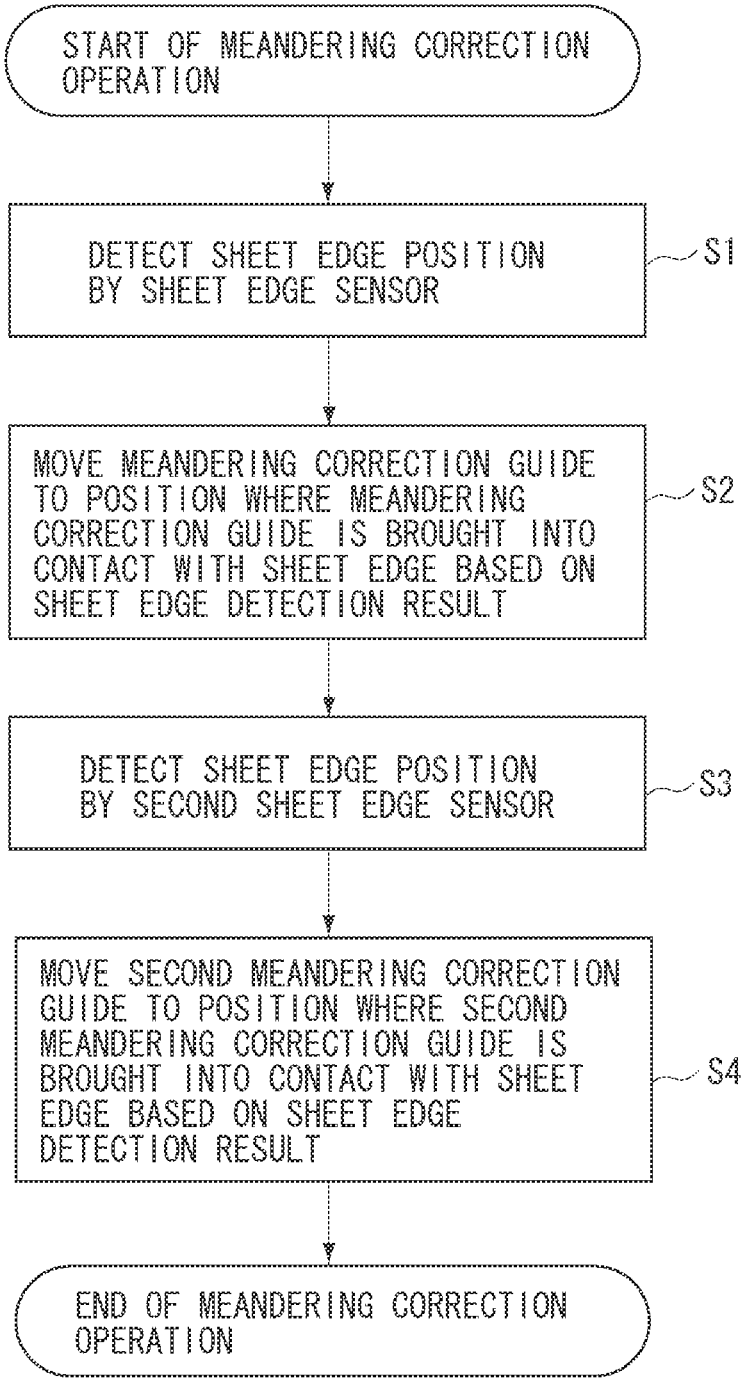
FIG. 15 is a flow chart illustrating a meandering correction operation.

Operations of sheet conveyance in the above configuration will be described. A meandering correction operation is described in the flow chart in FIG. 15. After a loop being generated in the loop area 156, a sheet S fed from the sheet feeding unit 1 passes through the meandering correction guide pair (153 and 154) and is conveyed by being nipped at each predetermined position by the third roller pair, the first roller pair, and the second roller pair in that order. The conveyance route from the first roller pair through the third roller pair to the meandering correction guide pair (153 and 154) is linear and substantially in one plane. Being linear here is not limited to being strictly linear and also includes approximately linear forms.

Figure 13A:
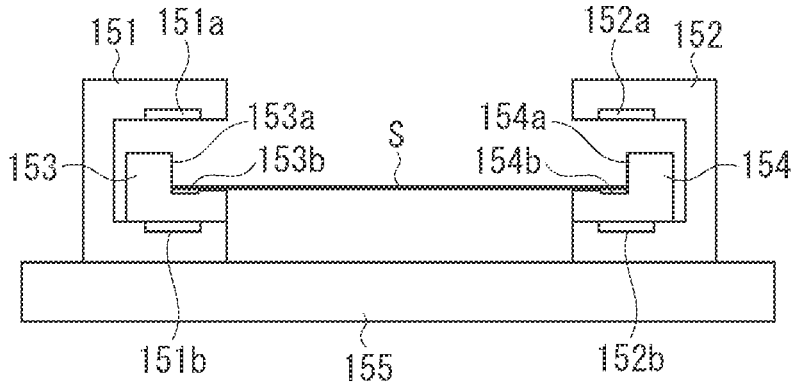
FIGS. 13A and 13B are detailed explanatory views of a meandering correction guide unit.
Figure 13B:
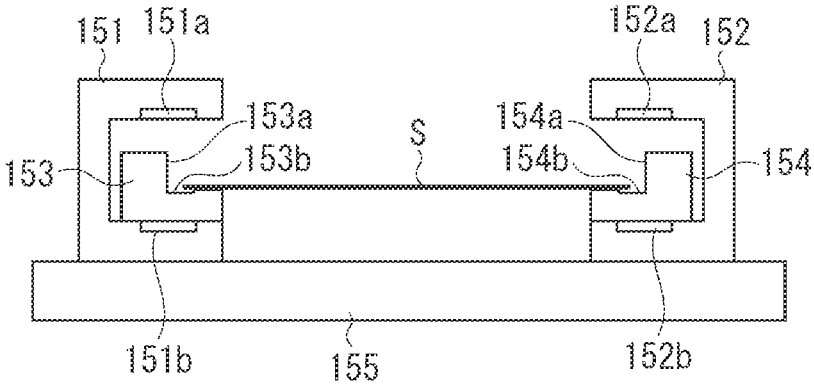

The meandering correction guides 153 and 154 are, as illustrated in FIG. 13B, initially on standby at positions away from sheet edges. After the sheet tip passes through the meandering correction guides, in step S1, the controller 300 detects sheet edges by the sheet edge sensors 151 and 152. In step S2, the controller 300 determines the amount of movement to cause the meandering correction guides 153 and 154 to just come into contract with sheet edges based on the sheet edge position detection result. Then, the controller 300 moves the meandering correction guides 153 and 154 to a position to just come into contact with sheet edges by moving the meandering correction guides 153 and 154 by the determined amount of movement (FIG. 13A). Since, as described above, the meandering correction guides 153 and 154 and the sheet edge sensors 151 and 152 that are aligned move integrally, sheet edges and the meandering correction guides 153 and 154 can be positioned with high precision. Thus, sheet buckling or deformation caused by thrusting sheet edges too far by the meandering correction guides 153 and 154 can be prevented. Moreover, there is no possibility of degraded meandering correction effect due to a too wide gap between sheet edges and the meandering correction guides 153 and 154.

Subsequently, the sheet tip portion is conveyed by the conveyance roller pair of the print unit. Here, to carry out sheet conveyance of sheet edges along the meandering correction guides 153 and 154 against a force to meander the sheet, the optimum configuration is to enable the sheet to easily rotate using the meandering correction guides 153 and 154 as a fulcrum. In the present configuration, the loop area 156 is provided upstream of the meandering correction guides 153 and 154. Since a sheet can be moved somewhat freely in the sheet width direction in the loop area, the meandering correction guide 153 or 154 is used as a fulcrum to make the sheet downstream therefrom rotatable. Thus, even if a force to meander acts on a sheet, the sheet can be conveyed easily along the meandering correction guides 153 and 154. While it is effective to increase a pressing force of a conveyance roller to improve feeding precision and an equivalent pressure is applied also in the present configuration, improved feeding precision can be made compatible with meandering corrections for the reason described above. If a pressing force (nipping force) of the conveyance roller is set lower or an operation to release a nip is performed halfway through conveyance to make a meandering correction easier, precision of the conveyance direction disadvantageously deteriorates even though meandering can be corrected. Forces that generate meandering by a conveyance roller pair include, for example, nonuniformity of a pressing force of a pinch roller in the sheet width direction and cylindricity (outside diameter error) of each roller in the sheet width direction. If, in contrast to the present configuration, a conveyance roller pair is provided also upstream of the meandering correction guides 153 and 154, a sheet may be constrained both upstream and downstream of the meandering correction guides so that the posture of the sheet cannot be changed by the meandering correction guides 153 and 154. As a result, depending on the type of sheet to be used, a malfunction such as buckling of the sheet or a crimped edge may occur. Such a malfunction is more likely to occur particularly when stiffness of the sheet is low.

After the sheet tip portion passes through the print area 110, in step S3, the controller 300 detects the sheet edge position by the second sheet edge sensors 160 and 161. In step S4, the controller 300 determines the amount of movement to cause the second meandering correction guides 177 and 178 to move to a position aligned with sheet edges based on the sheet edge position detection result. Then, the controller 300 moves the second meandering correction guides 177 and 178 by the determined amount of movement to move the second meandering correction guides 177 and 178 to the position aligned with sheet edges. The sheet tip generates a loop in the second loop area 175 after passing through the scanner 170 before being conveyed to between the second meandering correction guides 177 and 178 fitting to the sheet width. Subsequently, the sheet is conveyed by the pre-cutter roller pair (180 and 181) and is cut to desired sizes by the cutter 182 if necessary. Like the configuration upstream of the print area, an integral movable configuration may be adopted for the second sheet edge sensors 160 and 161 and the second meandering correction guides 177 and 178 by arranging both at close positions. Thus, the position of the second meandering correction guides 177 and 178 is aligned with sheet edges based on detection results by the second sheet edge sensors and, therefore, an alignment error of the guides to the sheet can be reduced so that an excellent meandering correction can be made. In an apparatus that has, like the present configuration, a plurality of heads and a wide print area, a higher meandering correction effect can be expected by arranging the second meandering correction guides also downstream of the print area to control a behavior of the sheet before and after the print area. Moreover, the second meandering correction guides 177 and 178 are provided near the cutter 182 on the upstream side and, therefore, meandering when the sheet is cut can be reduced so that excellent sheet cutting precision can be ensured. Further, the configuration has the second loop area 175 arranged near the second meandering correction guides 177 and 178 on the upstream side and the pre-cutter roller pair (180 and 181) arranged on the downstream side and, therefore, like upstream of the print area, an excellent meandering correction can be made without causing buckling of the sheet or broken edges.

Figure 16:
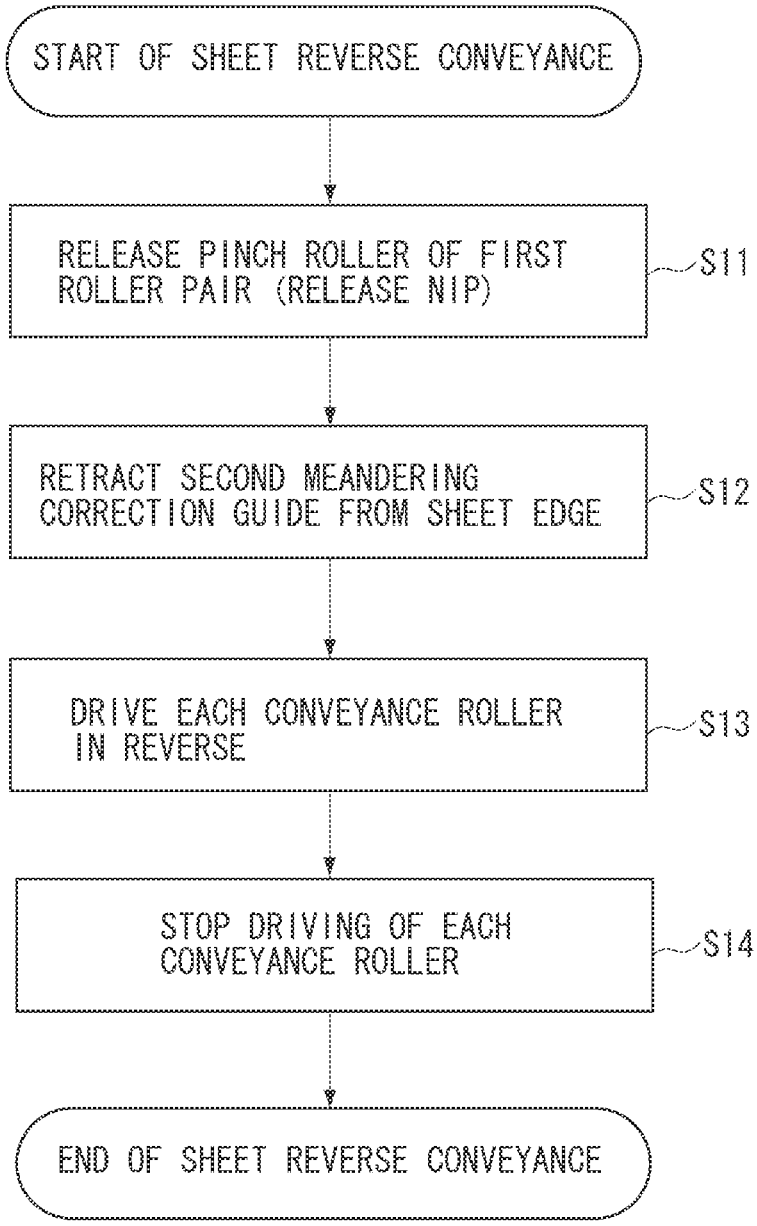
FIG. 16 is a flow chart illustrating the operation when a sheet is reverse-conveyed.

Next, the operation when a sheet is conveyed in a direction opposite to the normal conveyance direction (in a direction opposite to the direction A) to rewind the sheet will be described with reference to the flowchart in FIG. 16. First, in step S11, the controller 300 moves the pinch roller 102 of the first roller pair away from the conveyance roller 101 to release a nip. In the present configuration, the nipping force of the first roller pair positioned most upstream of the print head is set significantly higher than the other nipping forces. Thus, the sheet can be conveyed without causing buckling, wrinkles, and crimps of the sheet by releasing the nip by the nip release mechanism also when sheet edges are guided by the meandering correction guides 153 and 154 for conveyance in the opposite direction. Then, in step S12, the controller 300 retracts the second meandering correction guides 177 and 178 to positions away from sheet edges. Since it is enough to prevent the sheet from being significantly meandered or an occurrence of buckling, the sheet can sufficiently be guided by the meandering correction guides 153 and 154 on the upstream side alone. In step S13, the controller 300 drives each of the conveyance rollers 101, 103, and 105 in reverse. After the predetermined amount being driven, in step S14, the controller 300 stops each of the conveyance rollers 101, 103, and 105.

In the above exemplary embodiments, the printing unit 4 has a line print head of each color provided therein, but a similar configuration can also be implemented by another configuration, for example, a serial single print head. The meandering correction guide may have a configuration in which one side that comes into contact with a sheet edge presses against the sheet edge with an elastic member such as a spring. In this case, a slight positioning error of the meandering correction guide to the sheet edge can be absorbed depending on the type of sheet and thus, a margin for sheet buckling is further increased. The meandering correction guide can achieve an effect to a sheet edge even on one side. A configuration in which the sheet is pressed onto one side by, for example, a skew roller may be adopted.

A printing apparatus according to the exemplary embodiments described above has an arrangement relationship that a conveyance roller pair to convey a sheet using a nip is provided upstream of the printing unit 4, sheet edge sensors and meandering correction guides are provided further upstream thereof, and a loop area is provided still further upstream thereof. The printing apparatus also has the arrangement relationship that sheet edge sensors and meandering correction guides are provided also downstream of the printing unit and a loop area is further provided near the meandering correction guides on the upstream side thereof. With the above configuration, operation effects shown below can be achieved:

(1) Even if a nipping force of a conveyance roller pair downstream of meandering correction guides is set higher, a meandering connection can be made with precision. Thus, conveyance precision and meandering correction precision of roll paper can be achieved at the same time.

(2) The meandering correction guides can be brought into contact with sheet edges with precision. Thus, a precise meandering correction can be made without causing sheet buckling, crimps, and wrinkles.

(3) A print area, the conveyance roller pair, and the meandering correction guide pair are arranged substantially in one plane and thus, conveyance is less likely to be subject to stiffness of a sheet. Thus, it is relatively easy to control the sheet with precision. Consequently, excellent printing precision can be ensured.

(4) Meandering correction guides are provided also downstream of the print area so that excellent meandering correction precision can be maintained even if the print area is wide by guiding the sheet upstream and downstream of the print area.

(5) Excellent cutting precision can be ensured by arranging meandering correction guides upstream of a cutter unit. As a result, an excellent quality of a printed product can be maintained.

With the operation effects (1) to (5) described above, conveyance precision and meandering correction precision of sheet conveyance can be achieved at the same time at a high level so that a printing apparatus at a high level of printing quality can be provided.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2010-104295 filed Apr. 28, 2010 and No. 2010-108789 filed May 10, 2010, which are hereby incorporated by reference herein in their entirety.

What is claimed is:

1. An apparatus comprising:

a first conveyance unit configured to convey a sheet;

a first guide located downstream of the first conveyance unit in a conveyance direction and configured to guide a first side end of the conveyed sheet;

a skew unit configured to convey the sheet in an oblique direction to come closer to the first guide;

a second guide configured to contact a second side end opposite the first side end to guide the second side end;

a second conveyance unit including a driving roller and a driven roller, located downstream of the first guide in the conveyance direction; and a control unit configured to perform control so that, after conveying the sheet by the skew unit with the first side end contacting the first guide while the driving roller and the driven roller are separated from each other and the second guide is separated from the second side end, the second guide moves to a position close to the second side end, wherein the control unit controls so that, after the first side end contacts the first guide, the driving roller and the driven roller nip the sheet and the skew unit releases the sheet.

2. The apparatus according to claim 1, wherein the skew unit includes a skew driving roller, a skew driven roller, and a first separation and pressure unit configured to separate the skew driving roller and the skew driven roller or press the skew driving roller and the skew driven roller against each other.

3. The apparatus according to claim 2, wherein the control unit moves the second guide to the position close to the second side end and causes the second conveyance unit to convey the sheet while the skew driving roller and the skew driven roller are separated.

4. The apparatus according to claim 1, wherein the skew unit includes a driving roller, a driven roller, and a first separation and pressure unit configured to separate the driving roller and the driven roller from each other or press the driving roller and the driven roller against each other, and wherein the control unit controls the first separation and pressure unit and the first conveyance unit so that, after the sheet conveyed by the first conveyance unit arrives between the driving roller and the driven roller, the sheet is sandwiched between the driving roller and the driven roller by the first separation and pressure unit and, while the driving roller is stopped, the sheet is conveyed by the first conveyance unit to form a loop of the sheet.

5. The apparatus according to claim 4, further comprising a movement unit configured to move a guide member configured to guide the sheet between the first conveyance unit and the skew unit to a position allowing formation of the loop of the sheet, wherein the control unit controls the movement unit so that the guide member is moved when the loop of the sheet is formed.

6. The apparatus according to claim 1, further comprising a movement unit configured to move the first guide in a direction crossing the conveyance direction, wherein the control unit moves the first guide to a predetermined reference position before the sheet is guided to the first guide by the skew unit.

7. An apparatus comprising:

a print head configured to perform printing on a sheet;

a roller pair configured to convey the sheet by nipping the sheet upstream of the print head;

an end guide member configured to guide an end by contacting at least one side end of the sheet upstream of the conveyance roller pair;

a loop area for forming a loop shape of the sheet upstream of and near the end guide member;

a guide movement unit configured to move the end guide member in a sheet width direction; and a control unit configured to control the guide movement unit, a second end guide member configured to guide a second end by contacting at least one side end of the sheet downstream of the print head; and a second movement unit configured to move the second end guide member in the sheet width direction.

8. The apparatus according to claim 7, further comprising a detection unit configured to detect an end position of the sheet, wherein the detection unit is movable in the sheet width direction by the guide movement unit.

9. The apparatus according to claim 8, wherein the control unit determines an amount of movement of the end guide member by the guide movement unit based on a detection result of the end position of the sheet by the detection unit.

10. The apparatus according to claim 7, further comprising a bottom surface guide unit configured to guide a bottom surface of the sheet, wherein the bottom surface guide unit is movable by the guide movement unit.

11. The apparatus according to claim 7, further comprising a release mechanism configured to release a nip of the roller pair, wherein the nip of the roller pair is released by the release mechanism when the sheet is conveyed opposite to a direction for normal printing.

12. The apparatus according to claim 1, further comprising a loop area for allowing deformation of the sheet, the loop area being provided upstream of the first guide.

13. The apparatus according to claim 7, wherein the sheet is a continuous sheet wound like a roll, and wherein the apparatus further comprises a cut unit configured to cut the sheet downstream of the print head.

14. A sheet conveying apparatus comprising:

a first conveyance unit configured to convey a sheet;

a second conveyance unit including a driving roller and driven roller, located downstream of the first conveyance unit in a conveyance direction and configured to convey a sheet;

a first guide located between the first conveyance unit and the second conveyance unit and configured to guide a first side end of a sheet;

a skew unit configured to convey the sheet to a direction in which the first side end of the sheet comes closer to the first guide;

a second guide capable of moving in a direction intersecting with the conveyance direction and configured to guide a second side end of the sheet; and a control unit configured to drive, with the driving roller and the driven roller are separated from each other and the second guide being separated from the second side end of the sheet, the skew unit to convey the sheet so that the first side end of the sheet is pressed against the first guide, and subsequently cause the second guide to move, with the sheet being nipped by the driving roller and the driven roller, to a position at which the second guide comes in contact with the second side end of the sheet.

15. The sheet conveying apparatus according to claim 14, wherein the skew unit includes a skew driving roller and a skew driven roller, and wherein, with the skew driving roller and the skew driven roller being separated from each other, the control unit causes the second guide to move to the position at which the second guide comes in contact with the second side end of the sheet.

16. The sheet conveying apparatus according to claim 14, wherein the control unit causes the skew unit to stop while nipping the sheet and causes the first conveyance unit to convey the sheet to form a loop of the sheet.

17. The sheet conveying apparatus according to claim 16, further comprising a top surface guide provided between the first conveyance unit and the skew unit and configured to guide a top surface of the sheet, the top surface guide being capable of moving to a position at which formation of the loop of the sheet is allowed.

18. The sheet conveying apparatus according to claim 14, wherein the sheet is a continuous sheet in a roll form.

* * * * *